US007392966B1

(12) United States Patent
Chen

(10) Patent No.: US 7,392,966 B1
(45) Date of Patent: Jul. 1, 2008

(54) LEG OF A BILLIARD TABLE

(75) Inventor: Ying-Tse Chen, Tainan Hsien (TW)

(73) Assignee: Pai Li Business Co., Ltd., Tainan Hsien (TW)

( * ) Notice: Subject to any disclaimer, the term of this patent is extended or adjusted under 35 U.S.C. 154(b) by 0 days.

(21) Appl. No.: 11/715,434

(22) Filed: Mar. 8, 2007

(51) Int. Cl.
*F16M 11/20* (2006.01)

(52) U.S. Cl. ..... 248/188.8

(58) Field of Classification Search ..... 248/188.8, 248/188.1, 188.9, 677; 108/156, 190, 191, 108/186; 473/4
See application file for complete search history.

(56) References Cited

U.S. PATENT DOCUMENTS 4,412,667 A * 11/1983 Doerner ..... 248/188.7
4,807,838 A * 2/1989 Anderson ..... 248/188.1
5,881,980 A * 3/1999 Knudson ..... 248/188.8
6,086,028 A * 7/2000 Pfister ..... 248/188.8
6,213,452 B1 * 4/2001 Pettit et al. ..... 256/59
6,283,437 B1 * 9/2001 Kang ..... 248/677
2001/0032913 A1 * 10/2001 Gutgsell et al. ..... 248/188.1

* cited by examiner

*Primary Examiner*—Ramon O Ramirez
(74) *Attorney, Agent, or Firm*—Bacon & Thomas, PLLC

(57) ABSTRACT

A leg of a billiard table includes a central tube, two outer hoods, an upper and a lower supporting cover. The central tube has its two ends respectively fitted in an engaging sleeve of the upper and the lower supporting cover. One of the supporting covers has two horizontal locking grooves dug on its surface. The leg also includes two outer hoods having a chamber respectively to contain the central tube and the supporting covers while combining them together. At least one of the outer hoods has an upper and a lower locking groove for fitting with the supporting covers. The lower locking groove has locking strips for fitting with the horizontal locking grooves. Finally, screws are inserted through the top and the bottom of each of the outer hoods to be fixed with the supporting covers.

3 Claims, 6 Drawing Sheets

LEG OF A BILLIARD TABLE

BACKGROUND OF THE INVENTION

1. Field of the Invention

This invention relates to a leg of a billiard table, particularly to one that is collapsible for saving cost of delivery and powerful enough to support the billiard table.

2. Description of the Prior Art

Commonly, a table, such as a game table or a billiard table etc., has four legs positioned under four corners of its surface to sustain the table at a certain height for use. As shown in FIG. 1, a conventional leg 10 of a billiard table is made of solid lumber, having defects of great bulk, heavy weight and a high cost. Although a newer billiard table has been provided by some manufactures, having its leg replaced with slenderer solid lumber wrapped with decorative plastics in order to improve the defects mentioned above, but it is relatively to lower its supporting strength.

SUMMARY OF THE INVENTION

The objective of this invention is to offer a collapsible leg of a billiard table.

The main characteristics of the invention are a central tube, an upper and a lower supporting cover, and two outer hoods. The leg is provided with a central tube having its two ends respectively fitted in an engaging sleeve of the upper and the lower supporting cover. The upper supporting cover is provided with two upper screw holes bored at two sides of its top surface. The lower supporting cover is provided with two lower screw holes bored at two sides of its bottom surface, and two horizontal locking grooves dug from the edge of its bottom surface toward the center. The leg is also provided with two outer hoods, which are combined together to enclose the central tube positioned in the center. Each of the outer hoods is provided with a chamber facing each other after the two outer hoods are combined together. And, at least one of the outer hoods is provided with an upper and a lower locking groove formed inside it to respectively correspond to the upper and the lower supporting cover. Projected on an interior wall of the lower locking groove are two locking strips corresponding to the horizontal locking grooves of the lower supporting cover. In assembly, first, insert two ends of the central tube into the upper and the lower supporting cover, and next keep one side of the upper and the lower supporting cover fitted in the upper and the lower locking groove of the outer hood and the horizontal locking grooves engaged with the locking strips. Then, combine the two outer hoods together to enclose the central tube and the upper and the lower supporting cover. Finally, insert screws through the top and the bottom of each of the outer hoods and engage them with the upper and the lower supporting cover.

BRIEF DESCRIPTION OF DRAWINGS

This invention is better understood by referring to the accompanying drawings, wherein.

DETAILED DESCRIPTION OF THE PREFERRED EMBODIMENT

Figure 1:
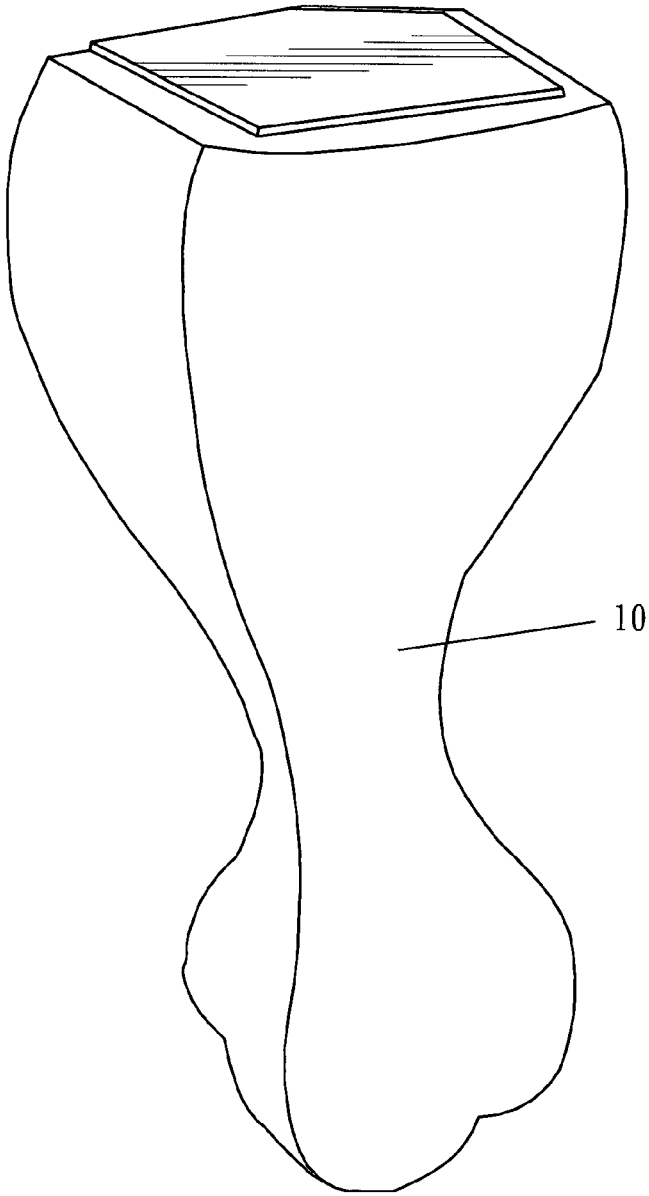
FIG. 1 (PRIOR ART)
FIG. 1 is a perspective view of a conventional leg of a billiard table.
Figure 2:
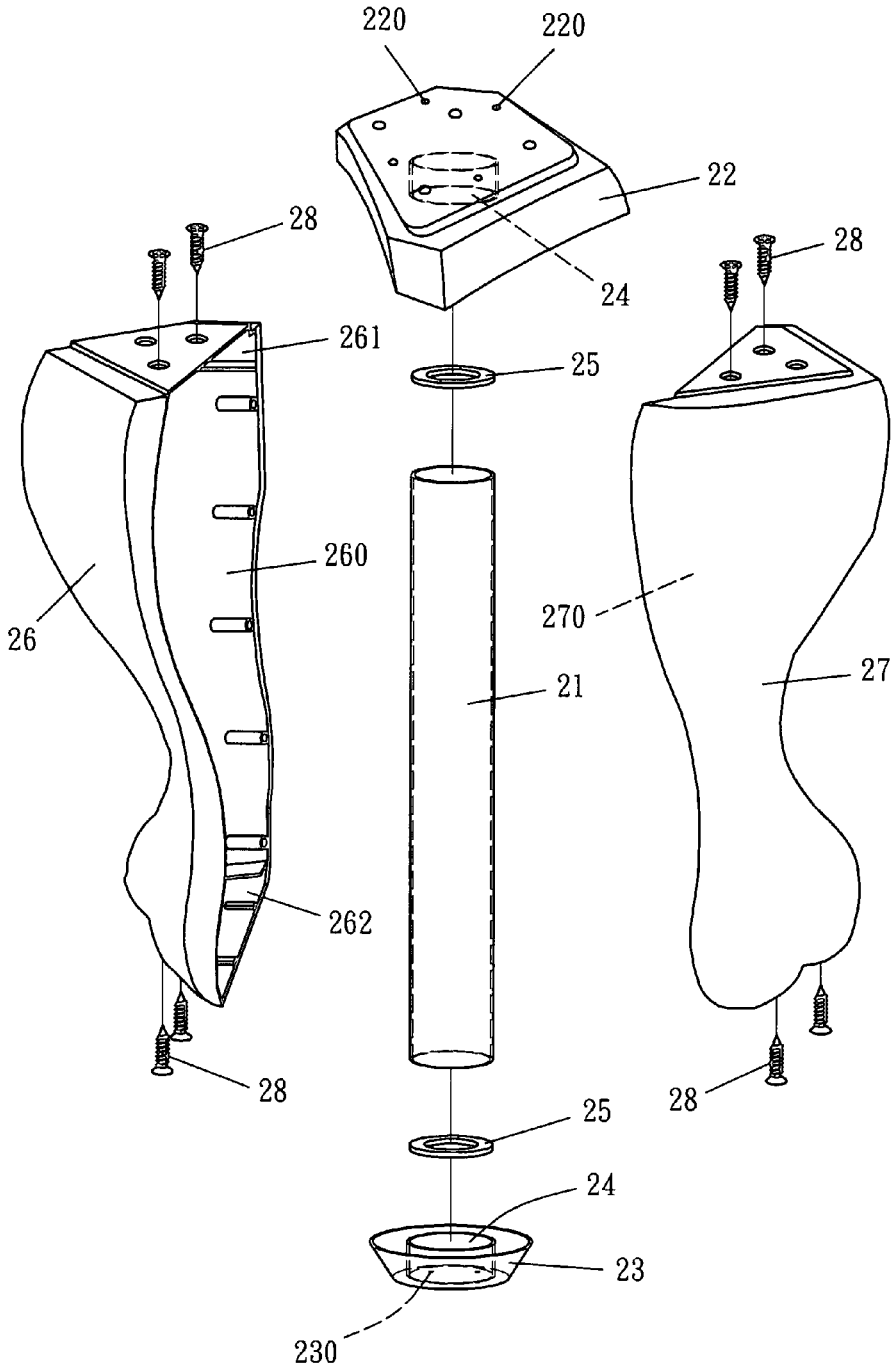
FIG. 2 is an exploded perspective view of a preferred embodiment of a leg of a billiard table in the present invention.
Figure 6:
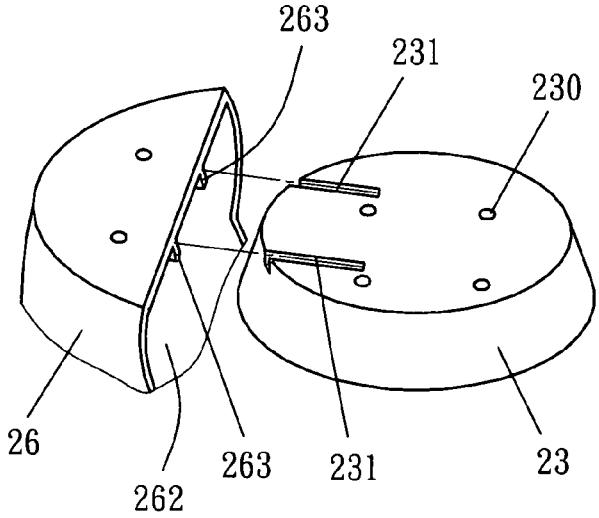
FIG. 6 is a bottom perspective view of the lower locking groove and a lower supporting cover of the preferred embodiment of a leg of a billiard table in the present invention, showing how they are engaged together.

As shown in FIG. 2, a preferred embodiment of a leg 20 of a billiard table is provided with a central tube 21 formed of a metallic tube, an upper supporting cover 22 positioned on the top of the central tube 21, and a lower supporting cover 23 positioned under the central tube 21. The upper supporting cover 22 and the lower supporting cover 23 is provided with an engaging sleeve 24 facing exactly to the central tube 21 and inserted with a washer 25 for protecting the upper supporting cover 22 or the lower supporting cover 23 from scratched by the central tube 21 after having two ends of the central tube 21 fitted in the upper and the lower supporting cover 22 and 23 to become a whole one. The upper supporting cover 22 is provided with two upper screw holes 220 bored at two sides of its top surface. And, the lower supporting cover 23 is provided with two lower screw holes 230 bored at two sides of its bottom surface, and two horizontal locking grooves 231 dug from the edge of its bottom surface toward the center, parallel with each other, as shown in FIG. 6.

Figure 4:
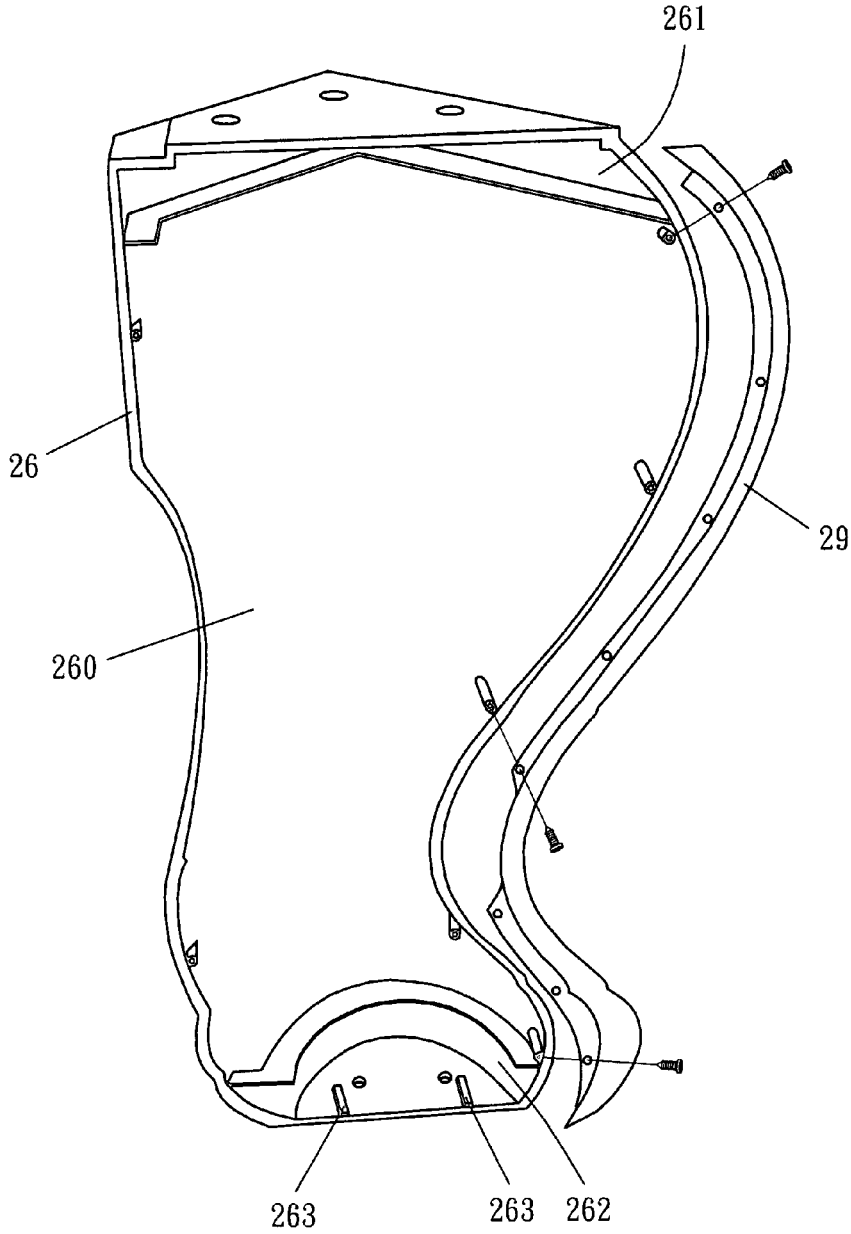
FIG. 4 is an exploded perspective view of an outer hood and a decorating strip of the preferred embodiment of a leg of a billiard table in the present invention.
Figure 5:
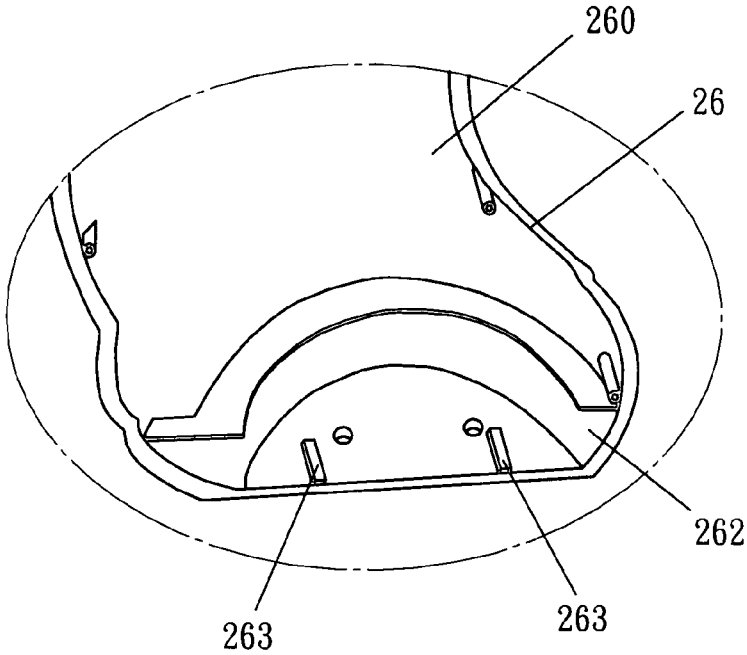
FIG. 5 is a perspective view of a lower locking groove of the outer hood in the preferred embodiment of a leg of a billiard table in the present invention.

The leg 20 is also provided with two outer hoods 26 and 27, which are combined together to hide the central tube 21, the upper and the lower supporting cover 22 and 23, with the central tube 21 positioned in the center. Each of the outer hoods 26 and 27 is provided with a chamber 260 or 270 used to enclose the central tube 21, and at least one of the chambers 260 and 270 is provided with an upper locking groove 261 and a lower locking groove 262 respectively formed in an upper and a lower interior wall of the chamber 260, for the upper and the lower supporting cover 22 and 23 to respectively fit in. The outer hood 26 is additionally provided with two locking strips 263 projected on an interior bottom of the lower locking groove 262 to correspond to the horizontal locking grooves 231 of the lower supporting cover 23, as shown in FIGS. 4~6, so that the horizontal locking grooves 231 can be fitted with the locking strips 263 to keep the lower supporting cover 23 tightly connected with the outer hood 26 while inserting the lower supporting cover 23 into the lower locking groove 262 of the outer hood 26. When the outer hoods 26 and 27 are connected together to hide and surround the central tube 21, the upper and the lower supporting cover 22 and 23, two screws 28 are inserted through the top and the bottom of each of the outer hoods 26 and 27 respectively and engaged with the upper and the lower screw holes 220 and 230 respectively. Thus, the leg 20 of the billiard table is assembled completely.

Next, as shown in FIG. 4, in order to beautify the connecting lines between the outer hoods 26 and 27 facing the outside of the billiard table, a decorating strip 29 can be fixed on the connecting lines to hide it.

The assembling procedure of the invention is described as follows.

1. Fit the washer 25 in the upper and the lower supporting cover 22 and 23 respectively, and next insert the two ends of the central tube 21 in the engaging sleeves 24 of the upper and the lower supporting cover 22 and 23.

2. Keep one side of the decorating strip 29 fixed on the edge of the outer hood 26 facing outward, as shown in FIG. 4. Next, install the central tube 21 and the upper and the lower supporting cover 22 and 23 in the chamber 260 of the outer hood 26, keeping the upper and the lower supporting cover 22 and 23 inserted into the upper and the lower locking groove 261 and 262 correspondingly and the horizontal locking grooves 231 of the lower supporting cover 23 inserted with the locking strips 263, as shown in FIG. 6, so as to keep the upper and the lower supporting cover 22 and 23 positioned in the outer hood 26.

Figure 3:
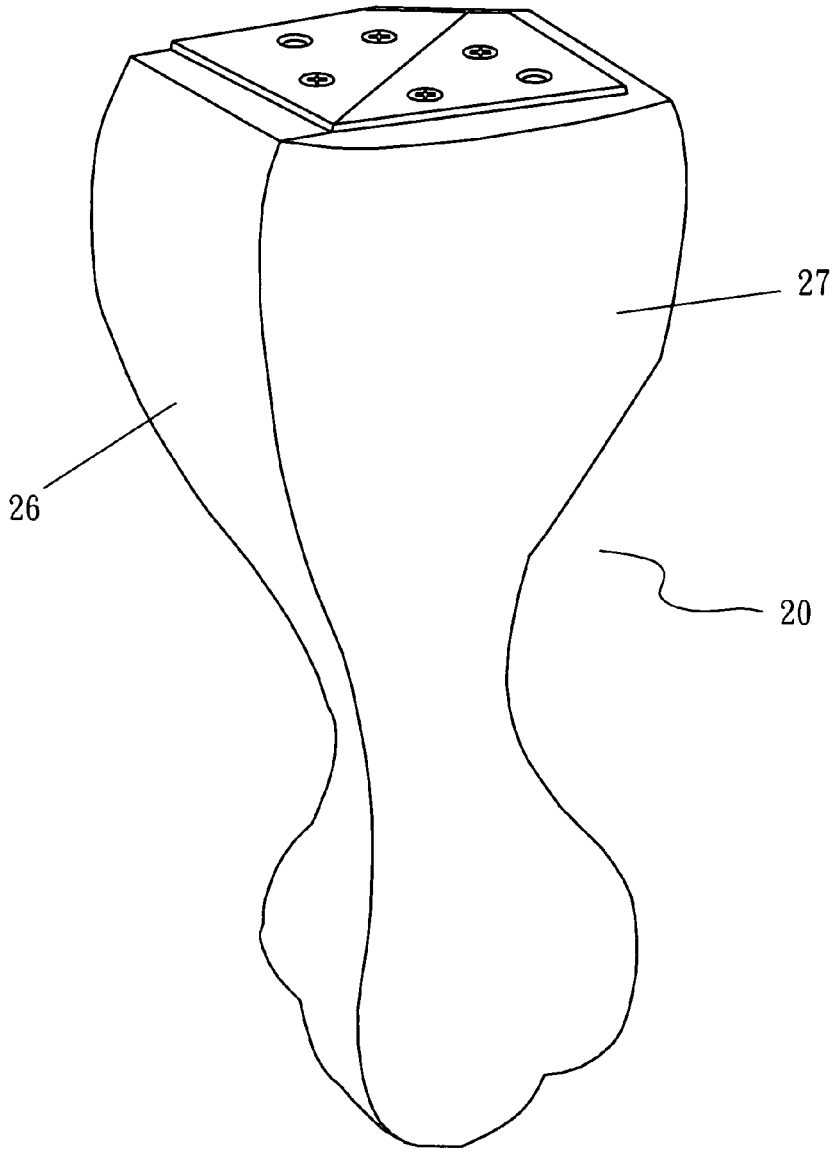
FIG. 3 is a perspective view of the preferred embodiment of a leg of a billiard table in the present invention.
Figure 7:
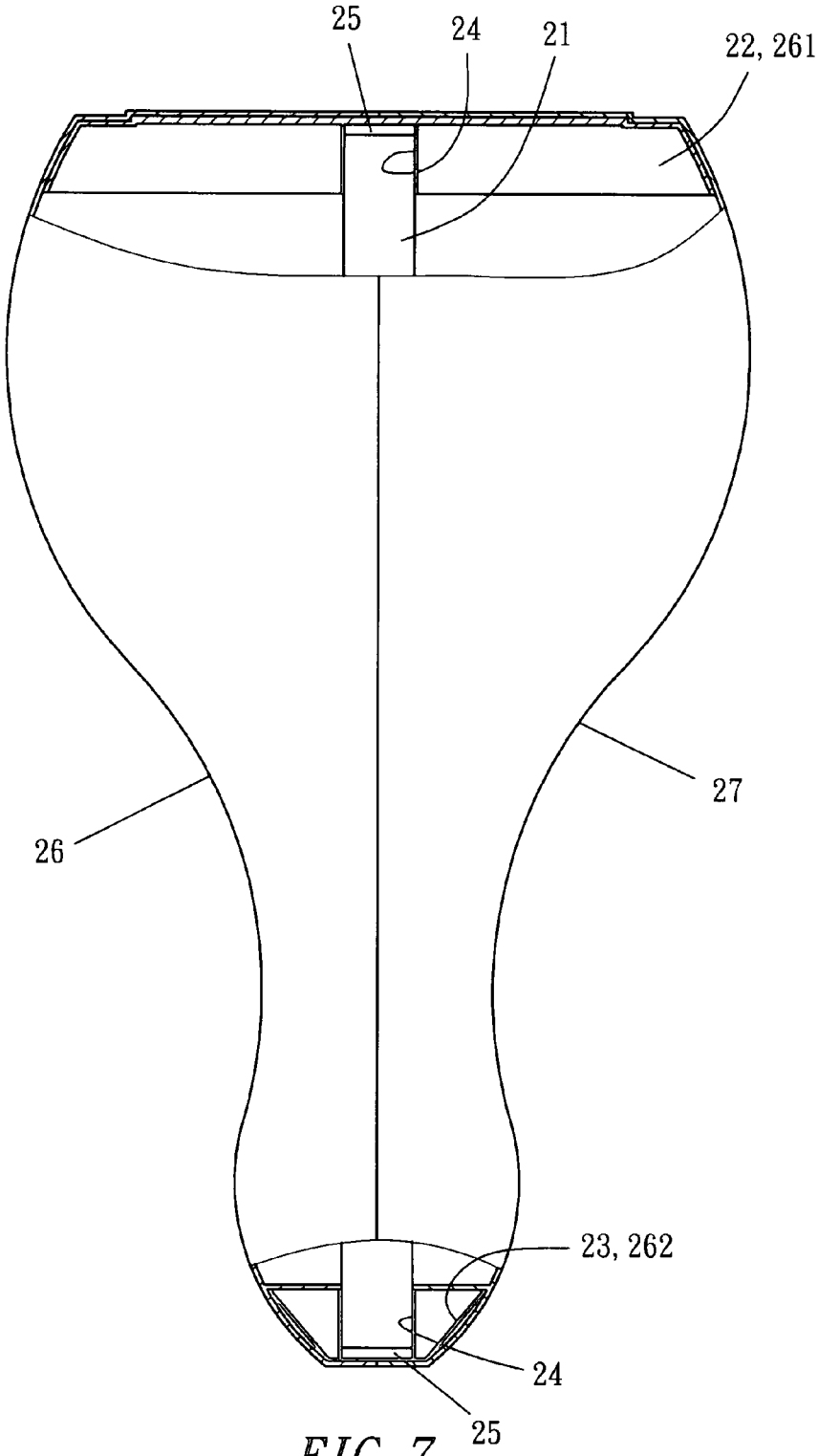
FIG. 7 is a front cross-sectional view of the preferred embodiment of a leg of a billiard table in the present invention.

3. Put the outer hood 27 engaged with the outer hood 26, so as to keep the central tube 21 and the upper and the lower supporting cover 22 and 23 wrapped by the outer hoods 26 and 27. Then, insert plural screws 28 respectively through the top and the bottom of each of the outer hoods 26 and 27 to be fixed with the upper and the lower supporting cover 22 and 23. So, the leg 20 of the billiard table in the present invention is completely assembled, as shown in FIGS. 3 and 7.

The advantages of the invention are described below as can be seen from the foresaid description.

The leg 20 of the billiard table can be disassembled to be packed in a minimal bulk, saving cost of delivery. After assembly, with the central tube 21 installed in the center of the outer hoods 26 and 27 and fixed deadly with the upper and the lower supporting cover 22 and 23 via the screws 28, the leg 20 of the billiard table has a very powerful supporting strength.

While the preferred embodiment of the invention has been described above, it will be recognized and understood that various modifications may be made therein and the appended claims are intended to cover all such modifications that may fall within the spirit and scope of the invention.

What is claimed is:

1. A leg of a billiard table comprising:

a central tube having its two ends respectively fitted in an engaging sleeve of an upper and a lower supporting cover, said lower supporting cover provided with two horizontal locking grooves dug from an edge of its bottom surface toward the center;

two outer hoods installed outside said central tube and said upper and said lower supporting cover to enclose them, each of said outer hoods provided with a chamber facing each other while they are combined together, at least one of said outer hoods provided with an upper locking groove and a lower locking groove respectively formed inside it to correspond to said upper and said lower supporting cover, and two locking strips projected on an interior wall of said lower locking groove to correspond to said horizontal locking grooves of said lower supporting cover; and in assembly two ends of said central tube inserted into said upper and said lower supporting cover, next one side of said upper and said lower supporting cover fitted in said upper and said lower locking groove of said first outer hood, said horizontal locking grooves engaged with said locking strips, then said second outer hood made to match with said first outer hood to keep said central tube and said upper and said lower supporting cover enclosed by them, finally screws inserted through a top and a bottom of each of said outer hoods to be fixed with said upper and said lower supporting cover.

2. A leg of a billiard table as claimed in claim 1, wherein a decorating strip is covered on a connecting between said outer hoods facing the outside of said billiard table for beautification.

3. A leg of a billiard table as claimed in claim 1, wherein said central tube is made of metal and said engaging sleeves are respectively inserted with a washer before said two ends of said central tube are inserted into them, for protecting said upper and said lower supporting cover.

* * * * *